US007025224B2

(12) United States Patent
Coleman

(10) Patent No.: US 7,025,224 B2
(45) Date of Patent: Apr. 11, 2006

(54) CAP FOR BEVERAGE CAN

(76) Inventor: Marian Coleman, 607 N. Main St., Brockton, MA (US) 02301

( * ) Notice: Subject to any disclaimer, the term of this patent is extended or adjusted under 35 U.S.C. 154(b) by 0 days.

(21) Appl. No.: 10/659,548

(22) Filed: Sep. 10, 2003

(65) Prior Publication Data

US 2004/0065662 A1 Apr. 8, 2004

(51) Int. Cl.
*B65D 43/04* (2006.01)

(52) U.S. Cl. ..... 220/802; 220/906

(58) Field of Classification Search ..... 220/802, 220/906, 254.1, 269–273
See application file for complete search history.

(56) References Cited

U.S. PATENT DOCUMENTS 3,698,593 A * 10/1972 Cvacho et al. ..... 220/203.29
4,442,950 A * 4/1984 Wilson ..... 220/269
4,463,866 A * 8/1984 Mandel ..... 220/269
4,576,306 A * 3/1986 Kelsey et al. ..... 220/271
4,609,121 A * 9/1986 Ludwig ..... 220/234
4,938,379 A * 7/1990 Kellner ..... 220/370
5,285,924 A * 2/1994 Morris ..... 220/694
5,351,853 A * 10/1994 Shock ..... 220/729
5,813,559 A * 9/1998 Cho ..... 220/258.2
5,911,794 A * 6/1999 Nordhoff ..... 81/3.55
6,059,137 A * 5/2000 Westwood et al. ..... 220/258.2
6,098,830 A * 8/2000 Jamieson ..... 220/259.1
6,102,236 A * 8/2000 Ohlsson et al. ..... 220/254.1
6,241,114 B1 * 6/2001 Savino et al. ..... 220/257.1
6,390,749 B1 * 5/2002 Song ..... 413/66
6,722,518 B1 * 4/2004 Bartz ..... 220/254.4
6,763,963 B1 * 7/2004 Martin ..... 220/254.2

FOREIGN PATENT DOCUMENTS

DE 19912880 * 1/2000 ..... 220/270
JP 8-244770 * 9/1996 ..... 220/270

* cited by examiner

*Primary Examiner*—Lien M. Ngo
(74) *Attorney, Agent, or Firm*—Myers & Kaplan, LLC; Sandra M. Drummond, Esq.

(57) ABSTRACT

A cap is provided for covering an opening in a soda can. The cap may include a depression and a peripheral flange connected to the depression. The peripheral flange may at least partially surround the depression. The depression may be adapted to fit into an opening of a soda can created by a pull tab. There may be a gap in the peripheral flange which allows a pull tab to fit over the depression. The cap may include an inner wall which connects the depression to the peripheral flange. A method is provided of pulling a pull tab on a soda can to create an opening in the soda can, and covering the opening with a cap.

4 Claims, 5 Drawing Sheets

CAP FOR BEVERAGE CAN

FIELD OF THE INVENTION

This invention relates to improved methods and apparatus concerning beverage containers.

BACKGROUND OF THE INVENTION

Typically in the prior art a pull tab aluminum beverage can, such as for soda or beer, cannot be closed after being opened.

SUMMARY OF THE INVENTION

The present invention, in one or more embodiments, provides an apparatus and a method for closing a soda can, after it has been opened. In one embodiment a cap is provided for covering an opening in a soda can. The cap may include a depression and a peripheral flange connected to the depression. The peripheral flange may at least partially surround the depression. The depression may be adapted to fit into an opening of a soda can created by a pull tab. There may be a gap in the peripheral flange which allows a pull tab to fit over the depression. The cap may include an inner wall which connects the depression to the peripheral flange.

The present invention, in one or more embodiments, may also include a method of pulling a pull tab on a soda can to create an opening in the soda can, and covering the opening with a cap. The cap may be comprised of a depression and a peripheral flange, wherein the depression is connected to the peripheral flange, and the peripheral flange at least partially surrounds the depression.

DETAILED DESCRIPTION OF THE DRAWINGS

Figure 1:
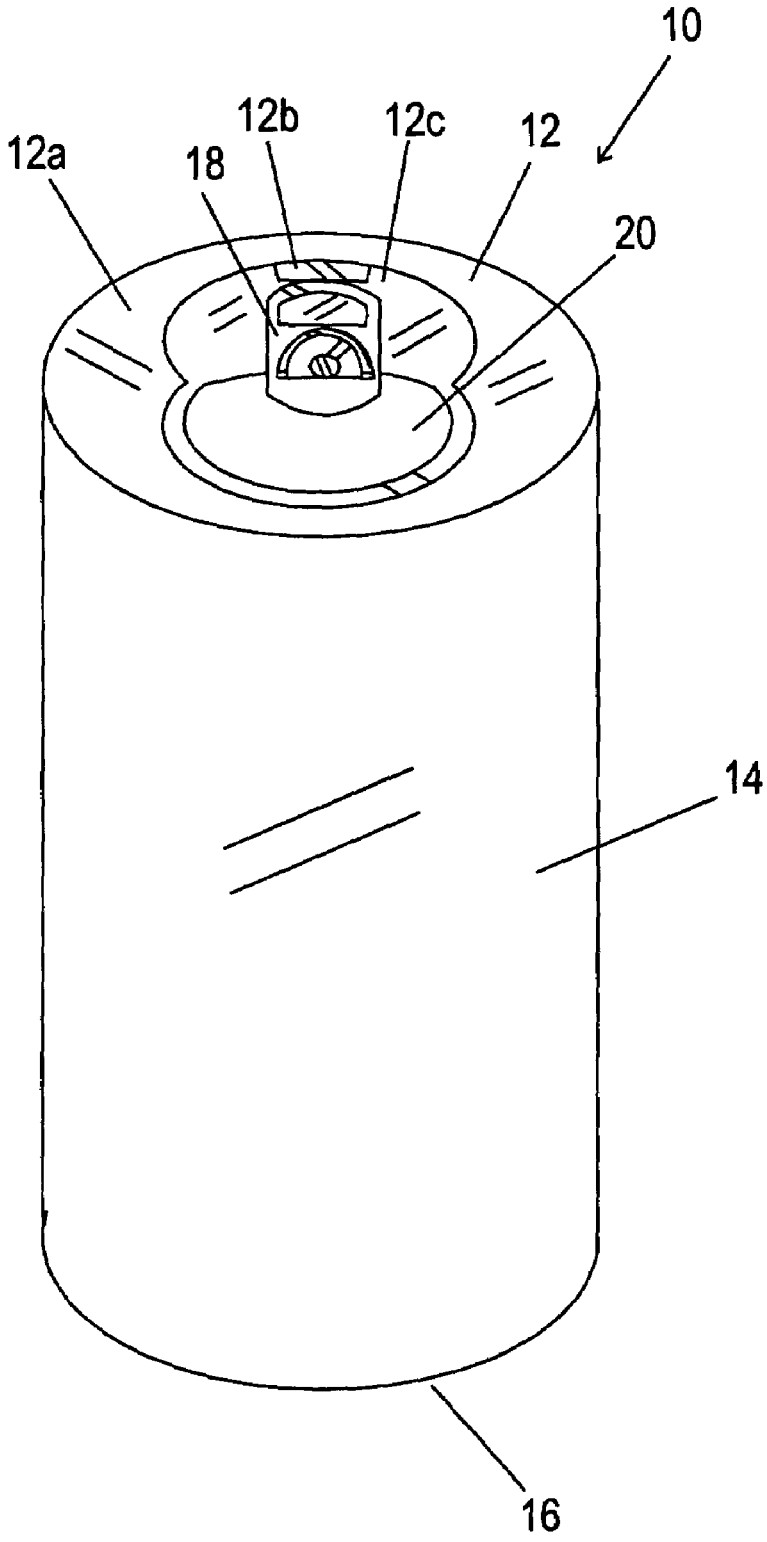
Fig. 1 (Prior Art)
FIG. 1 shows a front perspective view of a prior art soda can.

FIG. 1 shows a front perspective view of a prior art soda can 10. The can 10 includes top portion 12, body portion 14, and bottom portion 16. The top portion 12 includes sections 12*a*, 12*b*, and 12*c*. A tab or pull tab 18 is shown attached to the top portion 12. The tab has been used to open the can 10 so that there is an opening 20 in the can 10.

Figure 2:
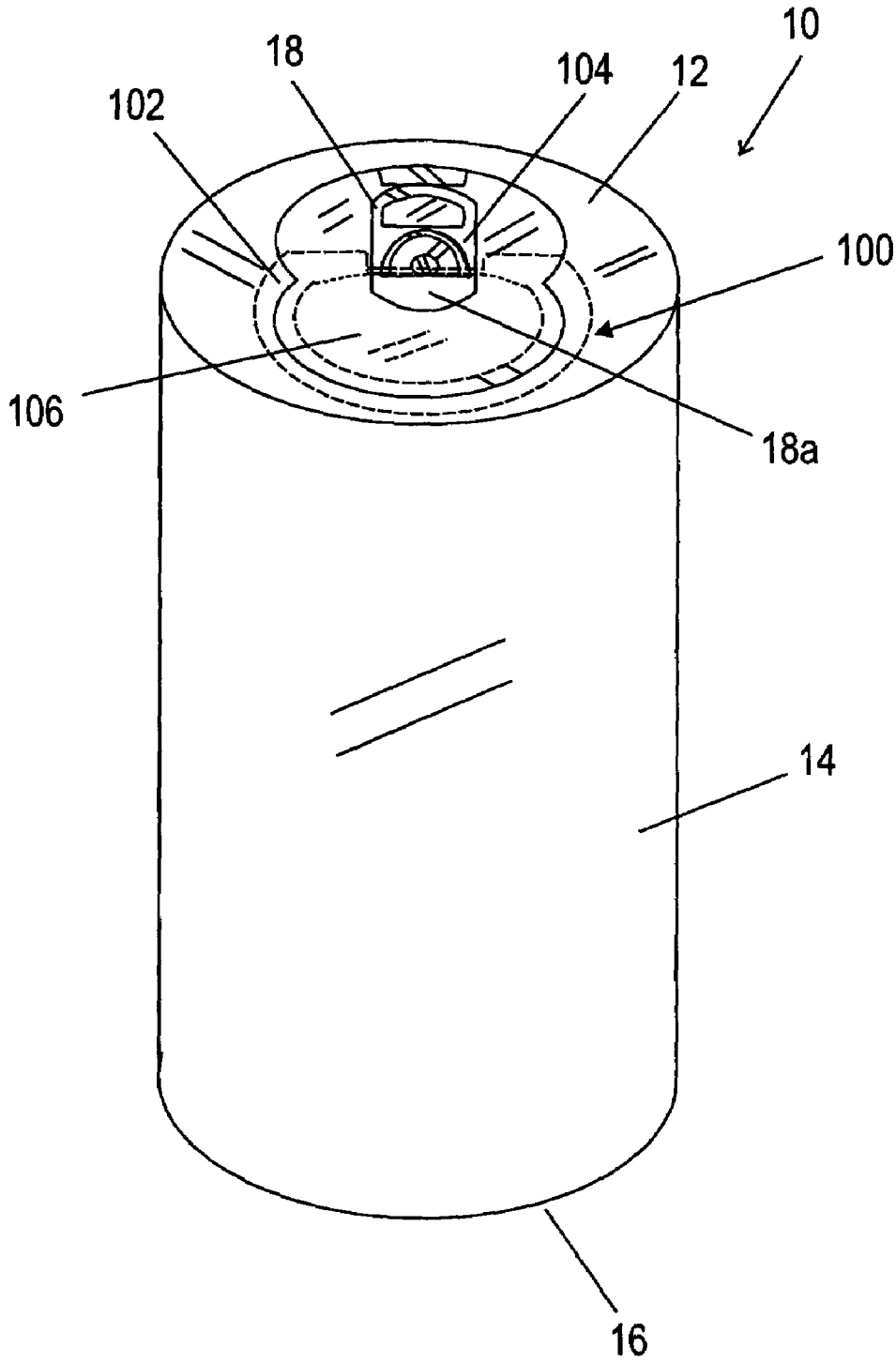
FIG. 2 shows a front perspective view of the can of FIG. 1 along with a cap in accordance with an embodiment of the present invention.

FIG. 2 shows a front perspective view of the can 10 of FIG. 1 along with a cap 100 in accordance with an embodiment of the present invention. The cap 100 is shown in dashed lines. The cap 100 includes a flange or outer rim 102 and a central depression or portion 106. There is a gap 104 in the outer rim 102 so that a portion 18*a* of the tab 18 can fit over the central depression portion 106. The central depression or portion 106 fits over and into the opening 20.

Figure 3A:
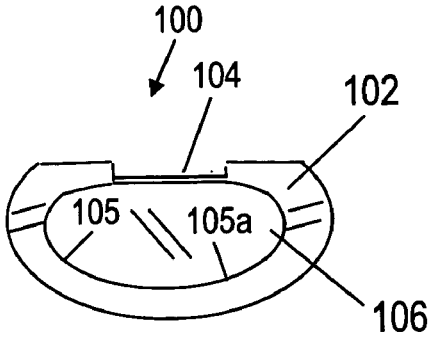
FIG. 3A shows a top view of the cap shown in FIG. 2.
Figure 3B:
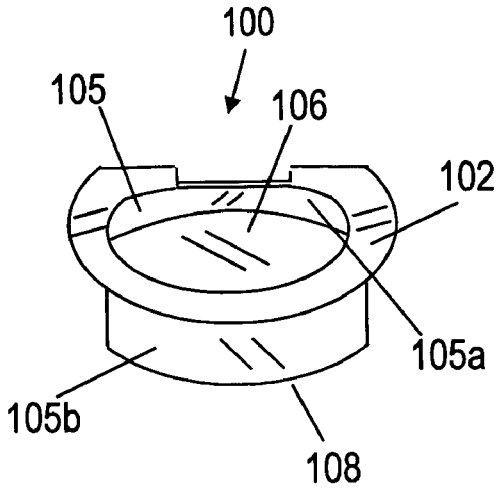
FIG. 3B shows a front perspective view of the cap shown in FIG. 2.
Figure 3C:
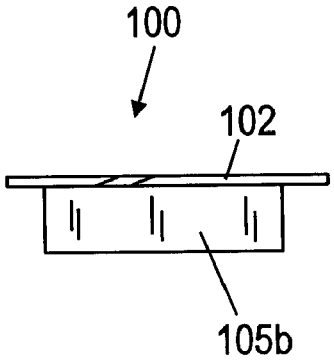
FIG. 3C shows a front view of the cap shown in FIG. 2.
Figure 3D:
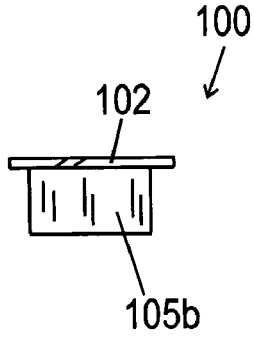
FIG. 3D shows a side view of the cap shown in FIG. 2.
Figure 3E:
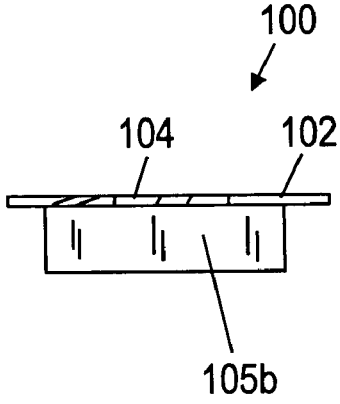
FIG. 3E shows a rear view of the cap shown in FIG. 2.
Figure 3F:
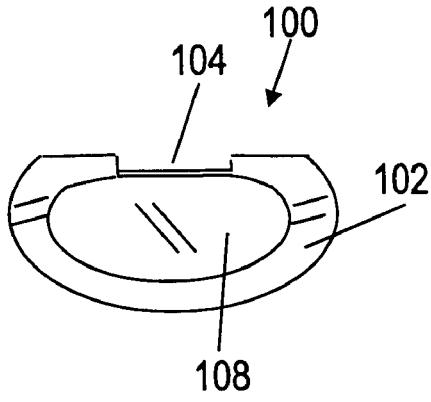
FIG. 3F shows a bottom view of the cap shown in FIG. 2.

FIGS. 3A, 3B, 3C, 3D, 3E, and 3F show top, front perspective, front, side, rear, and bottom views, respectively of the cap 100. FIG. 3B shows an inner wall 105 having an inner surface 105*a* and an outer surface 105*b*. FIG. 3F shows the bottom surface 108 of the depression 106. The cap 100 may resemble a hat in shape with the exception of gap 104.

In operation the indented portion 106 of the cap 100 can be inserted into the opening 20 of the can 10. The outer flange 102 of the cap 100 covers at least a portion of the to portion 12 of the can 10. The cap 100 provides a seal to keep any contents of the can 10 fresh after the tab 18 has been pulled to form the opening 20 in the can 10.

Figure 4:
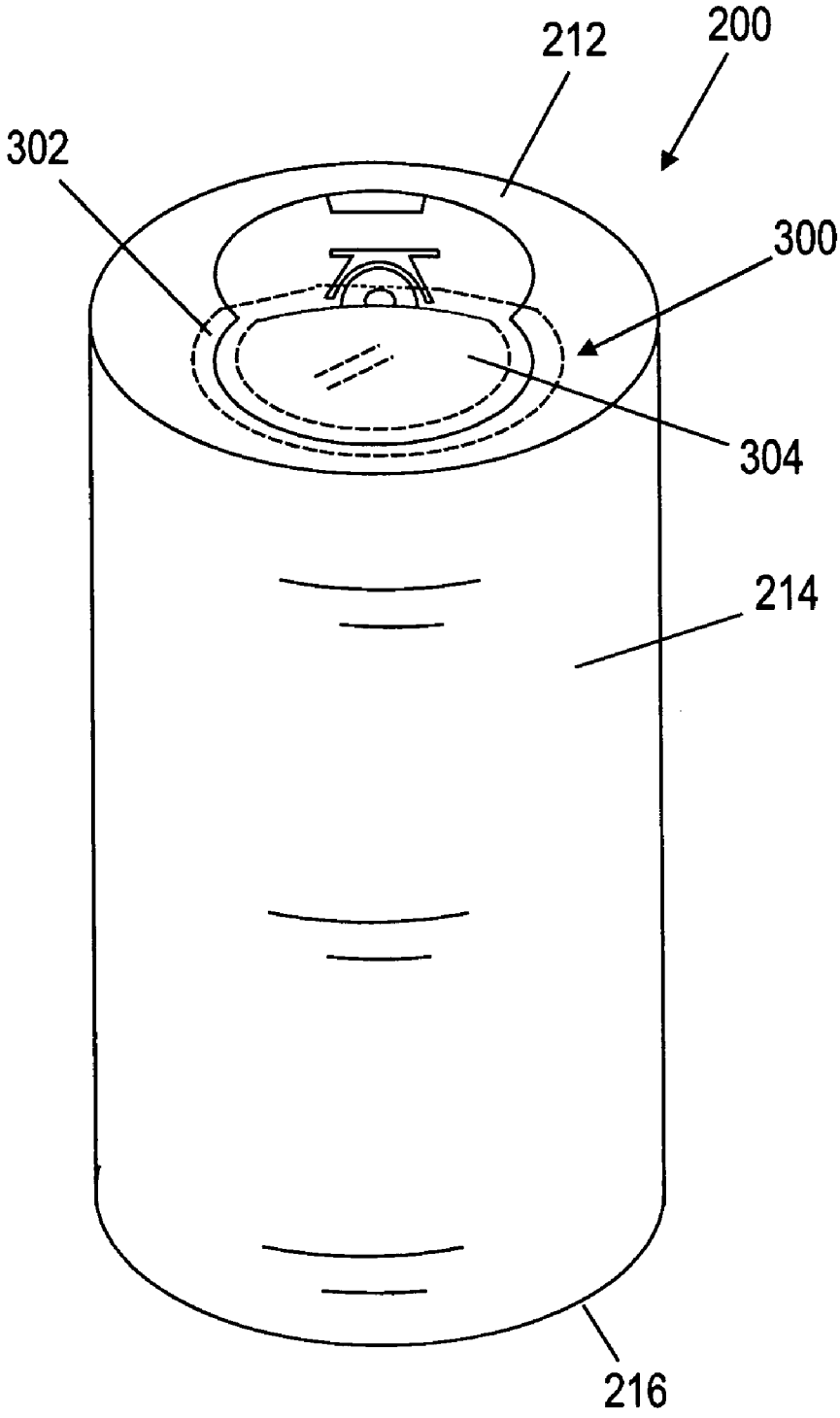
FIG. 4 shows a front perspective view of a can along with a cap in accordance with another embodiment of the present invention.
Figure 5A:
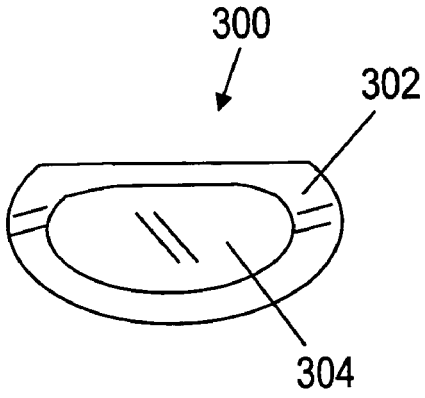
FIG. 5A shows a top view of the cap shown in FIG. 2.
Figure 5B:
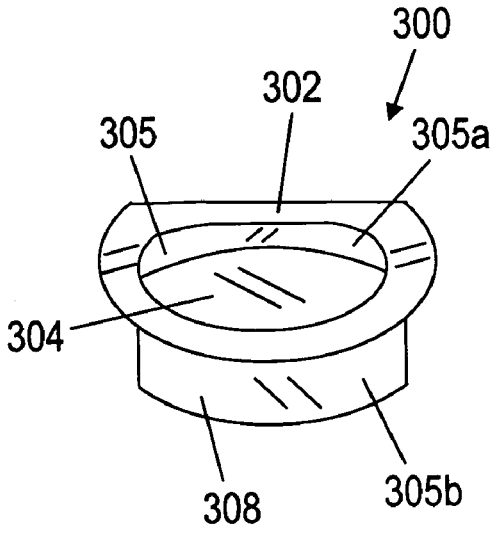
FIG. 5B shows a front perspective view of the cap shown in FIG. 2.
Figure 5C:
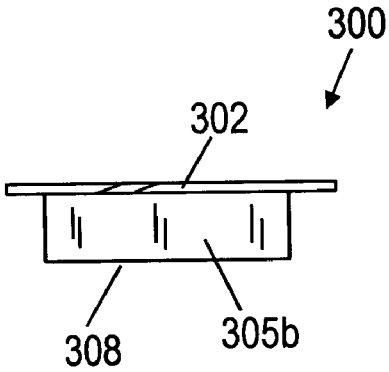
FIG. 5C shows a front view of the cap shown in FIG. 2.
Figure 5D:
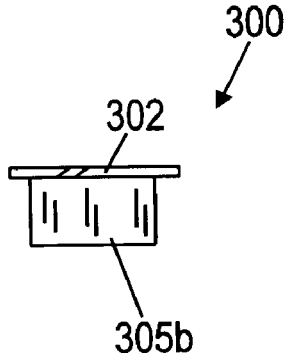
FIG. 5D shows a side view of the cap shown in FIG. 2.
Figure 5E:
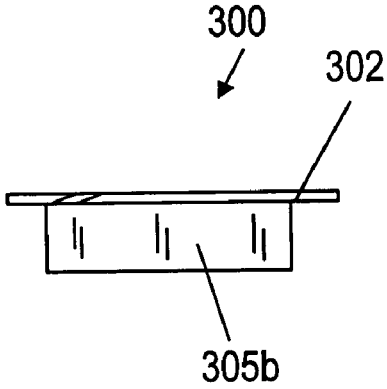
FIG. 5E shows a rear view of the cap shown in FIG. 2.
Figure 5F:
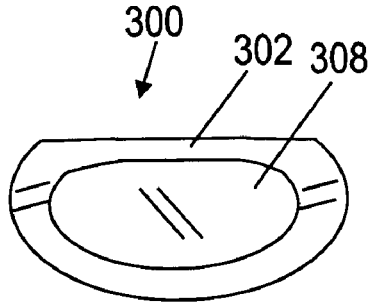
FIG. 5F shows a bottom view of the cap shown in FIG. 2.

FIG. 4 shows a front perspective view of a can 200 along with a cap 300 in accordance with another embodiment of the present invention. Cap 300 is shown in dashed lines in FIG. 4. The can 200 may be the same as the can 10 with the exception that the can 200 may not have a tab, like tab 18. Can 200 includes top portion 212, body portion 214, and bottom 216. Can 200 may substantially be a hollow cylinder.

FIGS. 5A, 5B, 5C, 5D, 5E, and 5F show top, front perspective, front, side, rear, and bottom views, respectively of the cap 300. The cap 300 has a flange or outer portion 302 and a depression 304. The cap 300 includes an inner wall 305 having an inner surface 305*a* and an outer surface 305*b*. The cap 300 has a bottom surface 308, shown in FIG. 5F. The cap 300 does not have a gap, like gap 104, in the flange or outer portion 302.

In operation the indented portion 304 of the cap 300 can be inserted into an opening 220 of the can 200. The outer flange 302 of the cap 300 covers at least a portion of the portion 212 of the can 200. The cap 300 provides a seal to keep any contents of the can 200 fresh by sealing the opening 220 in the can 200.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A can sealing apparatus comprising:

a cap base having an upper surface and an outer perimeter, said outer perimeter of said cap base dimensioned to facilitate insertion of said cap base into a flip-top can lid opening and a cap top defined by a peripheral flange extending outwardly relative to said outer perimeter of said cap base, proximate a first end of said cap base, said peripheral flange defining a generally flat C-shaped member having a first end and a second end, and by a flip-top can tab framing member positioned proximate said first end of said cap base and proximate said outer perimeter of said cap base, said flip-top can tab framing member defined in a non-flange region between said first end and said second end of said C-shaped member, thereby facilitating placement of flip-top can tab framing member of said can sealing apparatus in a position proximate to the exterior edges of an opened flip-top can tab that is extended vertically relative to a flip-top can lid surface when said cap base is inserted into said flip-top can top lid opening.

2. The can sealing apparatus of claim 1, wherein said cap base further comprises an interior wall, said interior wall extending from said upper surface to said peripheral flange of said cap top, thereby defining a depression.

3. A method of sealing an opened pull-tab can, comprising the steps of:

A. obtaining an opened pull-tab can;

B. obtaining a cap having a top and a bottom, said bottom having peripheral dimensions corresponding to the pull-tab can opening, said top being generally flat with peripheral dimensions greater than the pull-tab can opening, and said top having a notch defining an area at least slightly greater than the width of the can pull-tab;

C. positioning said cap with said notch of said top proximate the can pull-tab;

D. inserting said bottom of said cap into the pull-tab can opening, and

E. sealably covering the pull-tab can opening with said cap.

4. The method of claim 3 wherein said cap further comprises a depression said depression defined in said top; and further comprising step C': inserting the can pull-tab thereby facilitating insertion of said cap into the pull-tab can opening when the pull-tab is extended vertically relative to a can lid surface into said depression.

* * * * *